US008047187B2

(12) United States Patent
Ono et al.

(10) Patent No.: US 8,047,187 B2
(45) Date of Patent: Nov. 1, 2011

(54) FUEL FEED SYSTEM OF ENGINE

(75) Inventors: Yasuhide Ono, Saitama (JP); Teruyuki Saitoh, Saitama (JP); Tadayuki Yoneyama, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 752 days.

(21) Appl. No.: 11/993,780

(22) PCT Filed: Jun. 21, 2006

(86) PCT No.: PCT/JP2006/312447

§ 371 (c)(1),
(2), (4) Date: Dec. 21, 2007

(87) PCT Pub. No.: WO2006/137458

PCT Pub. Date: Dec. 28, 2006

(65) Prior Publication Data

US 2010/0037868 A1 Feb. 18, 2010

(30) Foreign Application Priority Data

Jun. 23, 2005 (JP) ..... 2005-183601
Jun. 23, 2005 (JP) ..... 2005-183602
Jun. 23, 2005 (JP) ..... 2005-183603

(51) Int. Cl.
*F02B 25/20* (2006.01)
*F02B 25/00* (2006.01)

(52) U.S. Cl. ..... 123/573; 123/DIG. 5

(58) Field of Classification Search ..... 123/573, 123/511, 517, 437, 198 D, DIG. 5; 261/67, 261/72.1; 55/290

See application file for complete search history.

(56) References Cited

U.S. PATENT DOCUMENTS 3,952,719 A * 4/1976 Fenton et al. ..... 123/198 DB
4,667,647 A * 5/1987 Ohtaka et al. ..... 123/573
4,790,287 A * 12/1988 Sakurai et al. ..... 123/573

(Continued)

FOREIGN PATENT DOCUMENTS

CL 1600-06 6/2005

(Continued)

OTHER PUBLICATIONS

Chilean Office Action dated Jul. 3, 2009, issued in corresponding Chilean Patent Application No. 1548-06.

(Continued)

*Primary Examiner* — Mahmoud Gimie

(74) *Attorney, Agent, or Firm* — Westerman, Hattori, Daniels & Adrian, LLP

(57) ABSTRACT

A fuel feed system of an engine is provided with a gas-fuel separating unit for separating oil mist generated in an engine case from air with a labyrinth, and an auto fuel cock is operated by pressure pulsation of the air from which the oil mist is separated by the gas-liquid separating unit. Thus, infiltration of the oil mist into the auto fuel cock is suppressed to the minimum, and a malfunction of the auto fuel cock caused by accumulation of the oil can be prevented. Additionally, a breather passage for feeding the air, from which the oil mist is separated by the gas-liquid separating unit, to a breathing unit is connected the auto fuel cock via a negative pressure tube. Thus, it is unnecessary to provide a specific passage for transmitting the pressure pulsation of the air in the engine case to the auto fuel cock.

16 Claims, 12 Drawing Sheets

U.S. PATENT DOCUMENTS

| | | | | |
|---|---|---|---|---|
| 5,027,758 | A * | 7/1991 | Siegler | 123/73 AD |
| 5,693,125 | A * | 12/1997 | Dean | 96/157 |
| 6,941,925 | B2 | 9/2005 | Yamada | |
| 6,973,922 | B2 * | 12/2005 | Yamada et al. | 123/495 |
| 2005/0028781 | A1 | 2/2005 | Yamada | |
| 2009/0064642 | A1 * | 3/2009 | Sato et al. | 55/290 |

FOREIGN PATENT DOCUMENTS

| | | | |
|---|---|---|---|
| EP | 1340905 | A2 | 9/2003 |
| EP | 1505291 | A1 | 2/2005 |
| GB | 2260365 | A * | 4/1993 |
| JP | 49-19118 | U | 2/1974 |
| JP | 51-120319 | A | 10/1976 |
| JP | 56-6059 | A | 1/1981 |
| JP | 59-13336 | Y2 | 4/1984 |
| JP | 61-97577 | U | 6/1986 |
| JP | 3-127890 | U | 12/1991 |
| JP | 4-237866 | A | 8/1992 |
| JP | 2003-171910 | A | 6/2003 |
| JP | 2007-002740 | A | 1/2007 |
| JP | 2007-002748 | A | 1/2007 |
| TW | 589437 | | 6/2004 |

OTHER PUBLICATIONS

International Search Report of PCT/JP2006/312447, date of mailing Sep. 5, 2006.

Japanese Office Action dated Apr. 7, 2009, issued in corresponding Japanese Patent Application No. 2005-183602.

Japanese Office Action dated Apr. 7, 2009, issued in corresponding Japanese Patent Application No. 2005-183603.

Taiwanese Office Action dated Apr. 29, 2009, issued in corresponding Taiwanese Patent Application No. 095121924.

European Search Report dated May 5, 2011, issued in corresponding European Patent Application No. 06767105.7.

* cited by examiner

FUEL FEED SYSTEM OF ENGINE

TECHNICAL FIELD

The present invention relates to a fuel feed system of an engine in which an auto fuel cock for controlling fuel feed from a fuel tank to the engine is operated by pressure pulsation of air in an engine case.

Additionally, the present invention relates to a fuel feed system of an engine in which an auto fuel cock is arranged between an engine case and a fuel tank fixed above the engine case, and in which an inside of the engine case is connected to the auto fuel cock via a negative pressure tube.

BACKGROUND ART

Disclosed in JP-A-2003-171910 is an apparatus in which an auto fuel cock for controlling fuel feed from a fuel tank to an engine is connected to a crank case of the engine via a feed tube, and the auto fuel cock is operated by pressure pulsation generated in the crank case.

Disclosed in JP-U-61-097577 is an apparatus in which a tip of a communicating tube extended from an auto fuel cock for controlling fuel feed from a fuel tank to an engine is opened in oil accumulating at a bottom part of a crank case, and the auto fuel cock is operated by pressure pulsation generated in the crank case.

Additionally, disclosed in JP-Y-59-013336 is a apparatus in which an suction part of a fuel cock is inserted into a discharge cylinder provided on a fuel tank via an oil seal constituted by an elastic material so that the fuel cock is attached to the bottom part of the fuel tank, and in which a cylindrical lock body constituted by an elastic body fitted onto the outer circumferences of the discharge cylinder and the suction part is tightened and fixed with a fixing instrument.

In an apparatus of JP-A-2003-171910, there is a possibility that a malfunction of an auto fuel cock is caused by accumulation of oil generated by condensation of oil mist which is generated in the crank case of the engine and infiltrates into the auto fuel cock through a feed tube.

Additionally, in an apparatus of JP-U-61-097577, since a tip of a communicating tube is opened in oil accumulating at the bottom part of a crank case, there is no possibility that oil mist infiltrates into the auto fuel cock through the communicating tube. However, there is a possibility that the oil in the crank case directly infiltrates into the auto fuel cock through the communicating tube when the engine is tilted.

On the other hand, when an auto fuel cock is arranged between an engine case and a fuel tank fixed above the engine case and the inside of the engine case is connected to the auto fuel cock via a negative pressure tube, there is a problem that work for connecting a lower end of the negative pressure tube to the inside of the engine case and for connecting an upper end of the negative pressure tube to the auto fuel cock is necessary and therefore much labor and time are required for the work. In particular, the above work becomes more difficult in a case where a working space between the fuel tank and the engine case is small. The distance between the engine case and the fuel tank increases when sufficient space is ensured, and thus there exists a problem the whole engine enlarges.

Additionally, it is conceived that a negative pressure introduction joint of the auto fuel cock fixed to a lower surface of the fuel tank to a negative pressure introduction joint of the engine case via an approximate crank-shaped is a bent negative pressure tube so that the whole engine is miniaturized by shortening the distance between the engine case and the fuel tank fixed above the engine case. However, this causes a possibility that oil which infiltrates from the engine case accumulates at a bent part of the negative pressure tube when the engine is tilted. When a tip of the negative pressure introduction joint of the auto fuel cock is soaked into the oil, there is a possibility that the operation of the auto fuel cock, of which the communication with the inside of the engine case is cut off, becomes impossible.

DISCLOSURE OF THE INVENTION

A first object of the present invention is to provide a fuel feed system of an engine for preventing a malfunction of an auto fuel cock caused by an infiltration of oil from an engine case.

A second object of the present invention is to provide a fuel feed system of an engine in which work for connecting an inside of an engine case to an auto fuel cock via an negative pressure tube is easy without increasing a distance between the engine case and a fuel tank.

A third object of the present invention is to provide a fuel feed system of an engine in which a negative pressure tube for connecting a negative pressure introduction joint of an auto fuel cock fixed to a lower surface of a fuel tank to the negative pressure introduction joint of an engine case is not blocked due to the oil.

In accordance with one or more embodiments of the present invention, a fuel feed system of an engine in which an auto fuel cock for controlling fuel feed from a fuel tank to the engine is operated by pressure pulsation of air in an engine case is provided with a gas-liquid separating unit for separating oil mist generated in the engine case from air. The auto fuel cock is operated by the pressure pulsation of the air from which the oil mist is separated by the gas-liquid separating unit.

The fuel feed system may include a breather passage for feeding the air from which the oil mist is separated by the gas-liquid separating unit to a breathing unit and makes the breather passage communicate with the auto fuel cock.

In the above fuel feed system, the breather passage may be arranged at an upper part of the engine case.

In the above fuel feed system, a first negative pressure introduction joint provided on the auto fuel cock may be connected to a second negative pressure introduction joint provided on the breather passage via the negative pressure tube.

In the above fuel feed system, the negative pressure tube may be monotonously tilted downward from the first negative pressure introduction joint to the second negative pressure introduction joint.

In accordance with one or more embodiments of the present invention, a fuel feed system of an engine is provided with: an engine case; a fuel tank fixed above an engine case; an auto fuel cock which is arranged between the engine case and the fuel tank and fixed to a lower surface of the fuel tank; and a negative pressure tube connecting an inside of the engine case to the auto fuel cock. The auto fuel cock has a first negative pressure introduction joint projected downward, the engine case has a second negative pressure introduction joint projected upward from an upper surface of the engine case. The negative pressure tube has a first connection part fitted onto the first negative pressure introduction joint and a second connection part fitted onto the second negative pressure introduction joint. The negative pressure tube is positioned so that the first connection part of the negative pressure tube, of which the second connection part is fitted onto the second negative pressure introduction joint, is located on a movement route of the first negative pressure introduction joint of the auto fuel cock when the fuel tank, to which the auto fuel cock is fixed, is moved downward to be fixed above the engine case.

In the fuel feed system, a positioning part for regulating an attachment posture of the negative pressure tube to the engine case may be provided between the negative pressure tube and the engine case.

In the above fuel feed system, the positioning part may have a recessed part provided on the negative pressure tube and a projection provided on the engine case. Alternatively, the positioning part may have a projection provided on the negative pressure tube and a recessed part provided on the engine case.

In the above fuel feed system, a taper part of which the outer diameter is reduced downward may be formed at a lower end of the first negative pressure introduction joint of the auto fuel cock.

In the above fuel feed system, the negative pressure tube may be monotonously tilted downward from the first negative pressure introduction joint to the second negative pressure introduction joint.

Further, a projection and a recessed part of the exemplary embodiment described below correspond to the positioning part of the present invention.

In the above fuel feed system, the negative pressure tube may have a middle part between the first connection part and the second connection part and be formed in an approximate crank shape, and the first negative pressure introduction joint may have a notch at the lower end thereof.

In the above fuel feed system, the notch of the first negative pressure introduction joint may be opened toward the middle part side of the negative pressure tube.

The above fuel feed system may include the gas-liquid separating unit for separating the oil mist generated in the engine case from the air and make the auto fuel cock operate by the pressure pulsation of the air from which the oil mist is separated by the gas-liquid separating unit.

The above fuel feed system may include the breather passage for feeding the air from which the oil mist is separated by the gas-liquid separating unit to the breathing unit and makes the breather passage communicate with the auto fuel cock.

In the above fuel feed system, the breather passage may be arranged at the upper part of the engine case.

According to one or more embodiments of the present invention, a fuel feed system is provided with the gas-liquid separating unit for separating oil mist generated in the engine case from air and the auto fuel cock is operated by pressure pulsation of the air from which the oil mist is separated by the gas-liquid separating unit. Thereby, infiltration of the oil mist into the auto fuel cock can be suppressed to the minimum and a malfunction of the auto fuel cock caused by accumulation of the oil can be prevented.

Additionally, a breather passage for feeding the air from which the oil mist is separated by the gas-liquid separating unit to a breathing unit is connected to the auto fuel cock. Thus, it is unnecessary to provide a specific passage for transmitting the pressure pulsation of the air in the engine case to the auto fuel cock.

Additionally, the breather passage is arranged at an upper part of the engine case. Thus, the oil mist, which has not been completely removed and infiltrates into the breather passage, can be suppressed to the minimum.

Additionally, a first negative pressure introduction joint provided on the auto fuel cock is connected to a second negative pressure introduction joint provided on the breather passage via the negative pressure tube. Thus, the degree of freedom of an attachment position of the auto fuel cock can be raised.

Additionally, the negative pressure tube is monotonously tilted downward from the first negative pressure introduction joint to the second negative pressure introduction joint. Thus, the oil in the negative pressure tube is discharged to the breather passage by gravity and can be more reliably prevented from infiltrating into the auto fuel cock.

According to one or more embodiments of the present invention, when the fuel tank, to which the auto fuel cock is fixed, is moved downward so as to be fixed above the engine case, the first negative pressure introduction joint of the auto fuel cock is automatically fitted into a first connection part of the negative pressure tube, of which a second connection part is previously fitted onto the second negative pressure introduction joint of the engine case. Thus, it becomes possible to simultaneously complete attachment of the fuel tank and attachment of the negative pressure tube, and work efficiency is greatly improved. Further, since it is unnecessary to provide a working space, where the first and second connection parts of the negative pressure tube are respectively fitted onto the first and second negative pressure introduction joints, between a lower surface of the fuel tank and an upper surface of the engine case, the fuel tank is made to approach the engine case as much as possible so that the whole engine can be miniaturized.

Additionally, the positioning part for regulating an attachment posture of the negative pressure tube to the engine case is provided between the negative pressure tube and the engine case. Thus, the first negative pressure introduction joint of the auto fuel cock can be easily fitted into the first connection part of the negative pressure tube.

Additionally, the positioning part is constituted by a recessed part provided on the negative pressure tube and a projection provided on the engine case. Alternatively, the positioning part is constituted by a projection provided on the negative pressure tube and a recessed part provided on the engine case. Thus, the attachment posture of the negative pressure tube to the engine case can be easily and reliably regulated by engaging the projection with the recessed part.

Additionally, a taper part, of which the outer diameter is reduced downward, is provided at a lower end of the first negative pressure introduction joint of the auto fuel cock. Thus, the first negative pressure introduction joint of the auto fuel cock can be easily fitted into the first connection part of the negative pressure tube when the fuel tank is moved downward so as to be fixed above the engine case.

Additionally, the negative pressure tube is monotonously tilted downward from the first negative pressure introduction joint to the second negative pressure introduction joint. Thus, the oil infiltrating into the negative pressure tube is discharged by gravity, and can be reliably prevented from infiltrating into the auto fuel cock.

Additionally, the negative pressure tube has a middle part between the first connection part and the second connection part and is formed in an approximate crank shape, and the first negative pressure introduction joint has a notch at the lower end thereof. Thus, even if the engine is tilted so that the first connection part side of the middle part of the negative pressure tube is lowered and even if the oil is accumulated at the corners of the middle part and the first connection part, the auto fuel cock can be made to operate without any trouble so long as the notch formed at the lower end of the first negative pressure introduction joint is not soaked into the oil. That is why communication of the inside of the engine case and the auto fuel cock is not cut off.

Additionally, the notch of the first negative pressure introduction joint is opened toward the middle part side of the negative pressure tube. Thus, the notch can be hardly soaked into the oil even if the oil is accumulated at the corners of the middle part and the first connection part of the negative pressure tube.

Additionally, the gas-liquid separating unit for separating the oil mist generated in the engine case from the air is provided, and the auto fuel cock is made to operate by the pressure pulsation of the air from which the oil mist is separated by the gas-liquid separating unit. Thus, the infiltration of the oil mist into the auto fuel cock is suppressed to the minimum, and the malfunction of the auto fuel cock caused by the accumulation of the oil can be prevented.

Additionally, the breather passage for feeding the air from which the oil mist is separated by the gas-liquid separating unit to the breathing unit is made to communicate with the auto fuel cock. Thus, it is unnecessary to provide the specific passage for transmitting the pressure pulsation of the air in the engine case to the auto fuel cock.

Additionally, the breather passage is arranged at the upper part of the engine case. Thus, the oil mist, which has not been completely removed and infiltrates into the breather passage, can be suppressed to the minimum.

Other aspects and advantages of the invention will be apparent from the following description and the appended claims.

DESCRIPTION OF REFERENCE NUMERALS AND CHARACTERS

Figure 1:
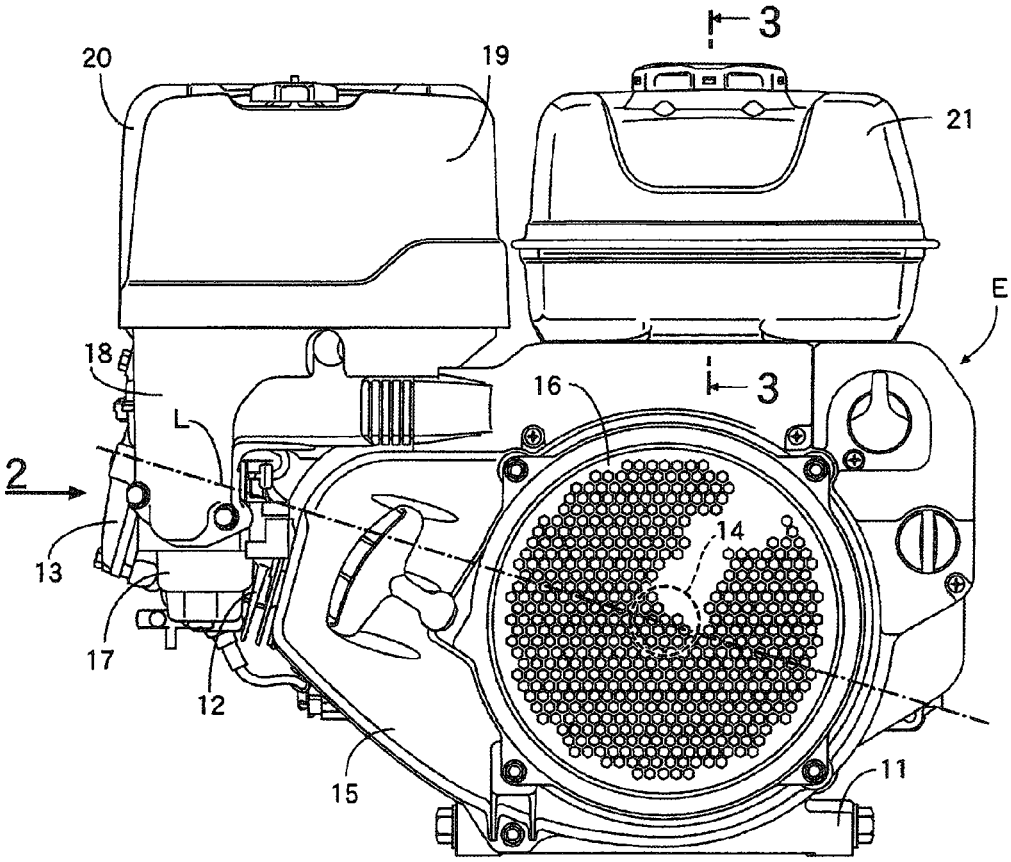
FIG. 1 is a front view of a general purpose engine.

11 engine case
11*b* second negative pressure introduction joint
11*c* projection
11*e* breather passage
21 fuel tank
30 auto fuel cock
32*a* first negative pressure introduction joint
32*d* taper part
32*e* notch
38 negative pressure tube
38*a* first connection part
38*b* second connection part
38*c* middle part
38*d* recessed part
52 breathing unit
61 gas-liquid separating unit
E engine

BEST MODE FOR CARRYING OUT THE INVENTION

Exemplary embodiments of the present invention will be described hereinafter with reference to the accompanying drawings.

Figure 2:
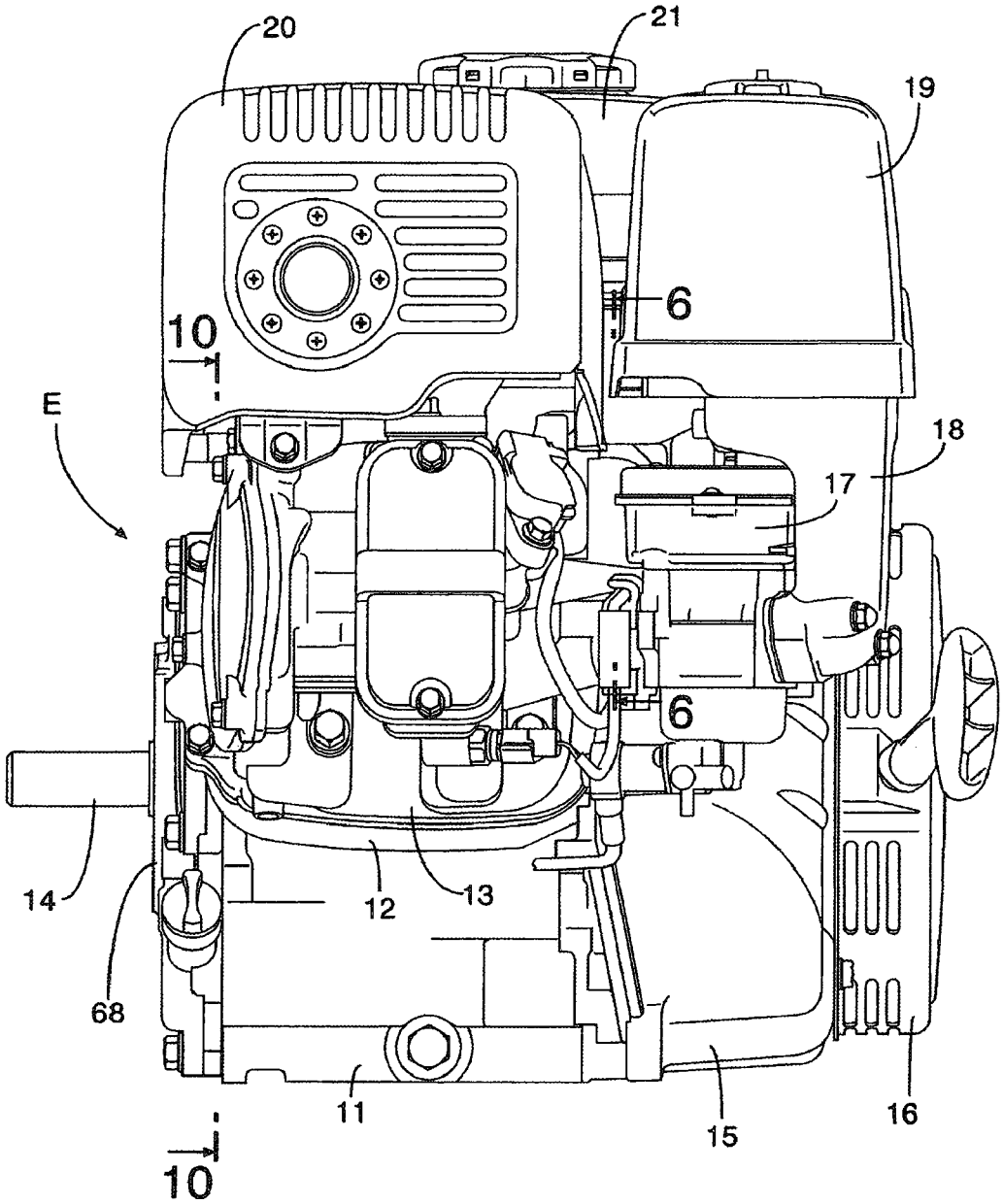
FIG. 2 is a view when being viewed from the arrow 2 in FIG. 1.
Figure 3:
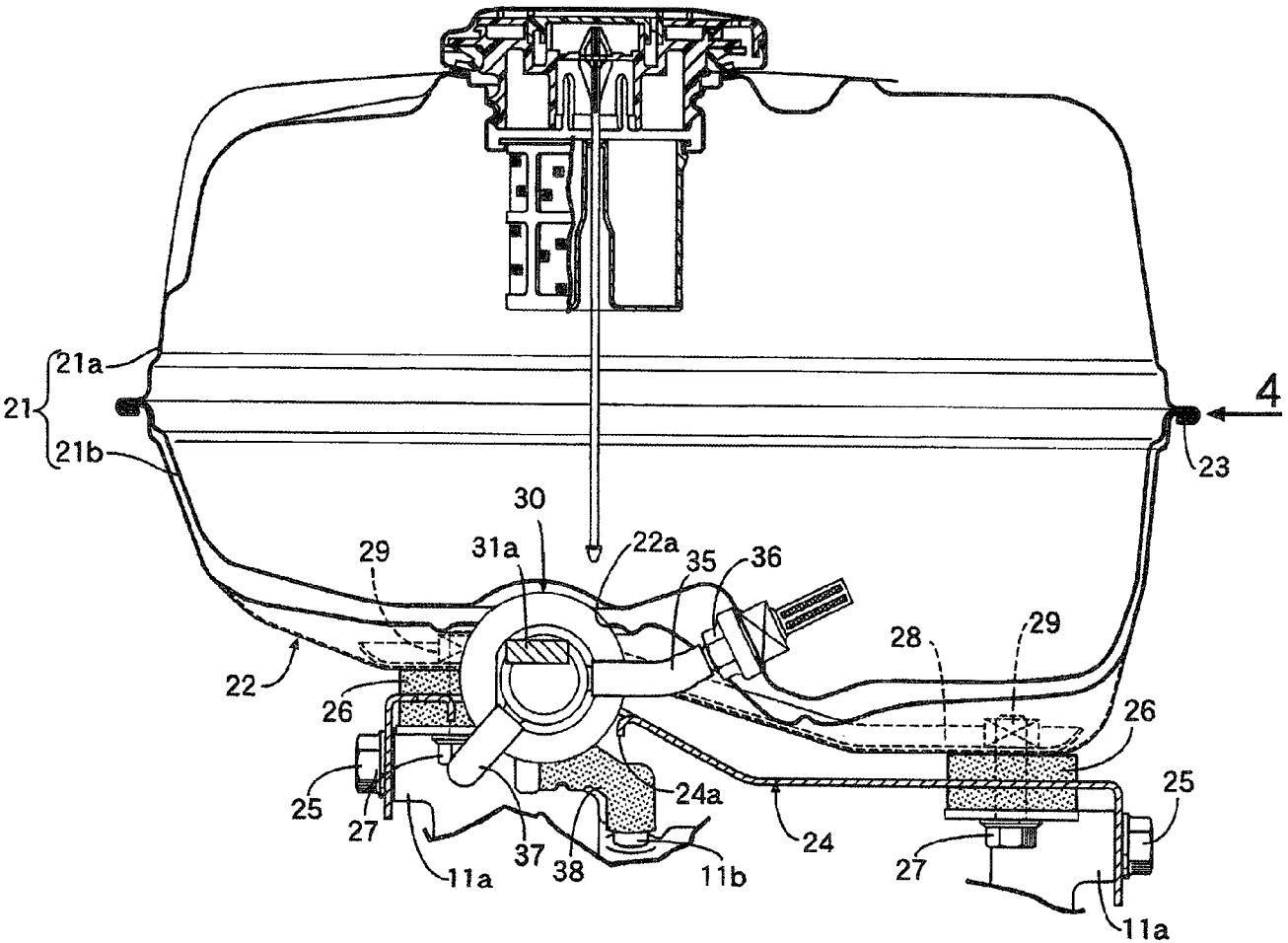
FIG. 3 is an enlarged cross sectional view taken along line 3-3 in FIG. 1.
Figure 4:
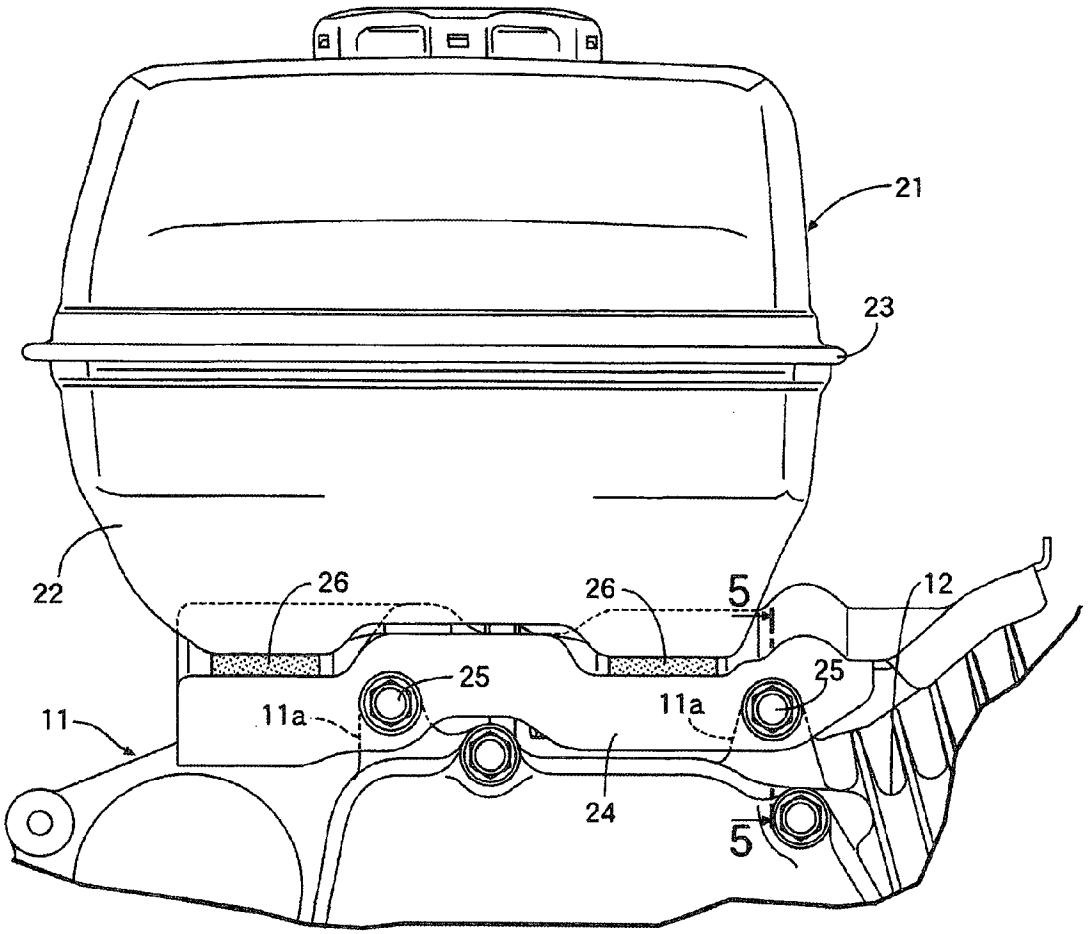
FIG. 4 is a view when being viewed from the arrow 4 in FIG. 3.
Figure 5:
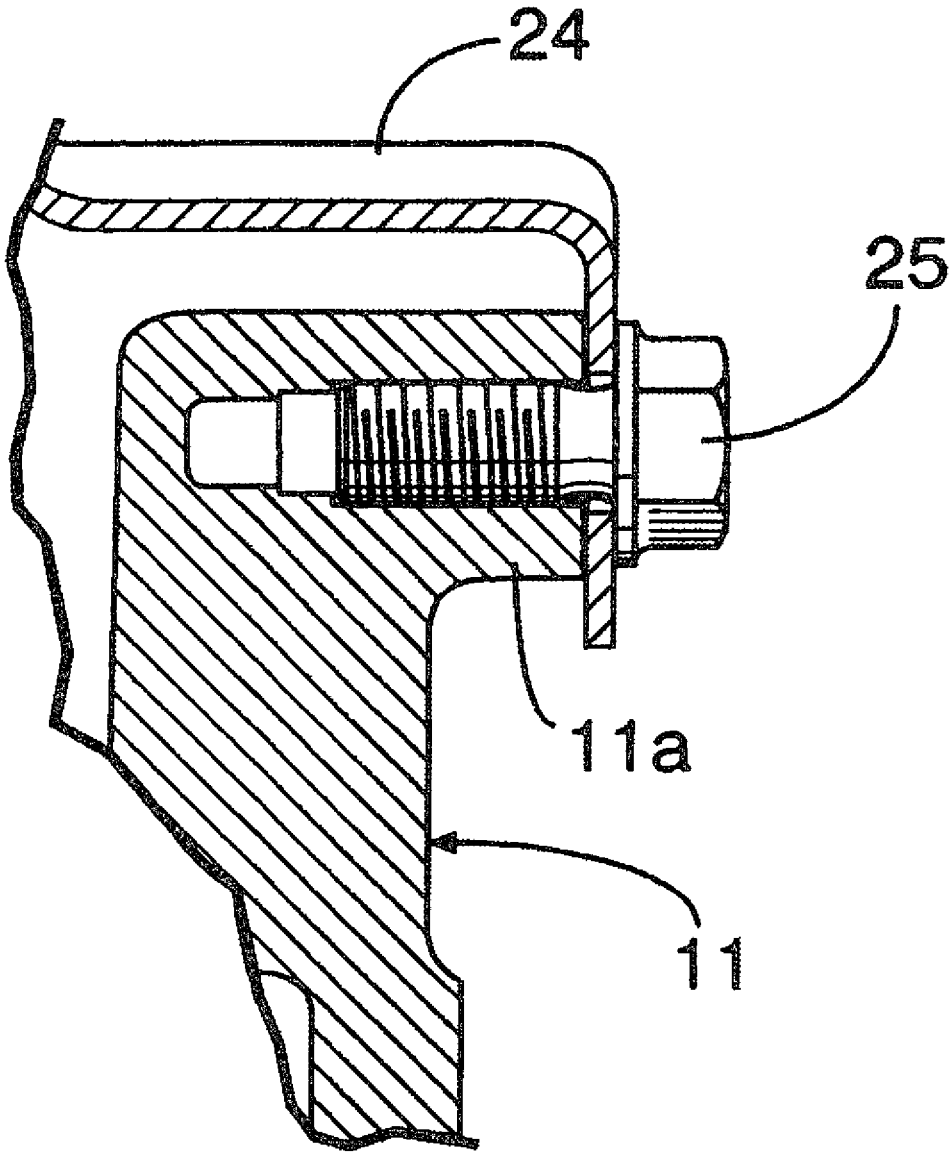
FIG. 5 is an enlarged cross sectional view taken along line 5-5 in FIG. 4.
Figure 6:
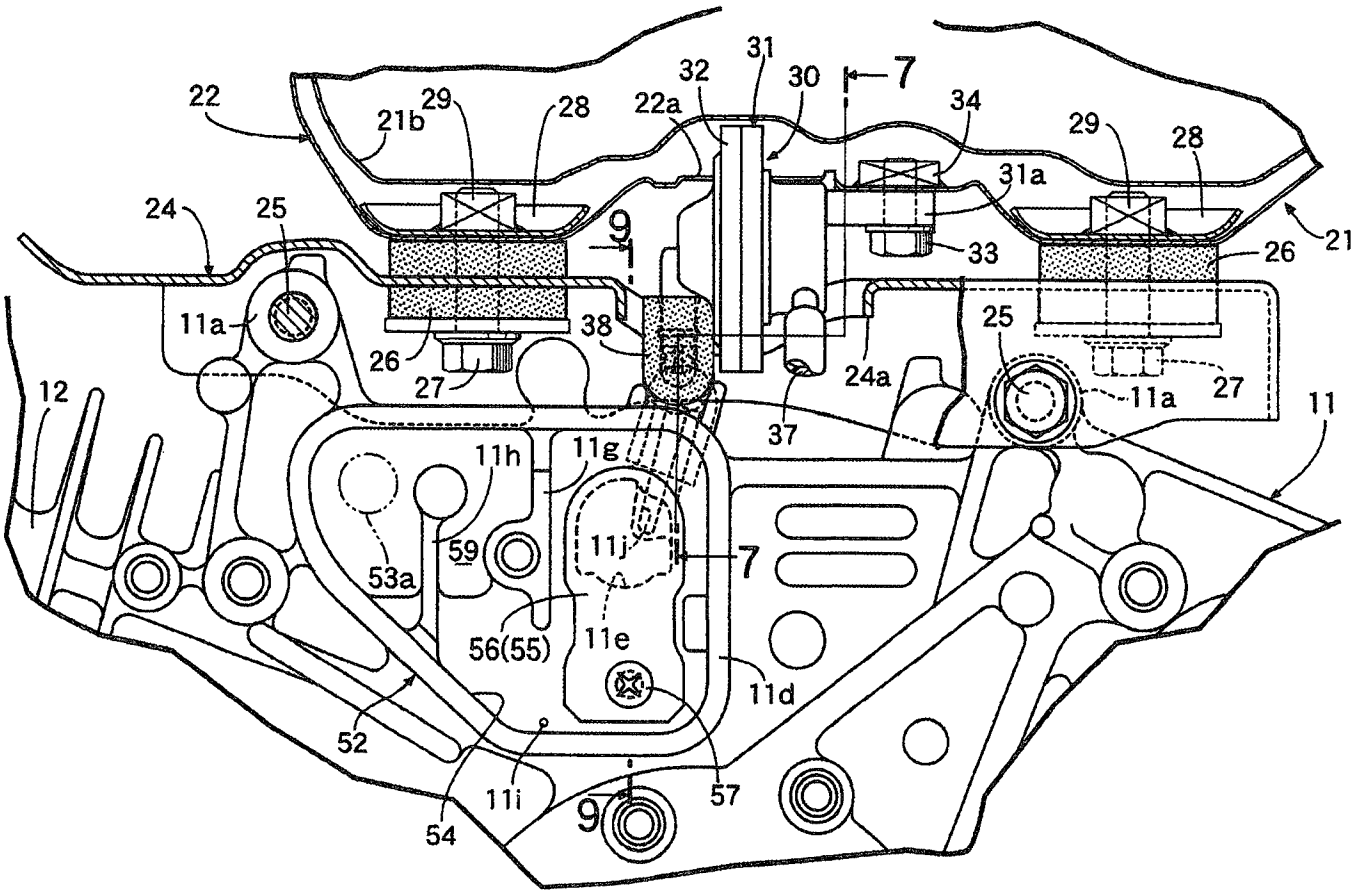
FIG. 6 is an enlarged cross sectional view taken along line 6-6 in FIG. 2.
Figure 7:
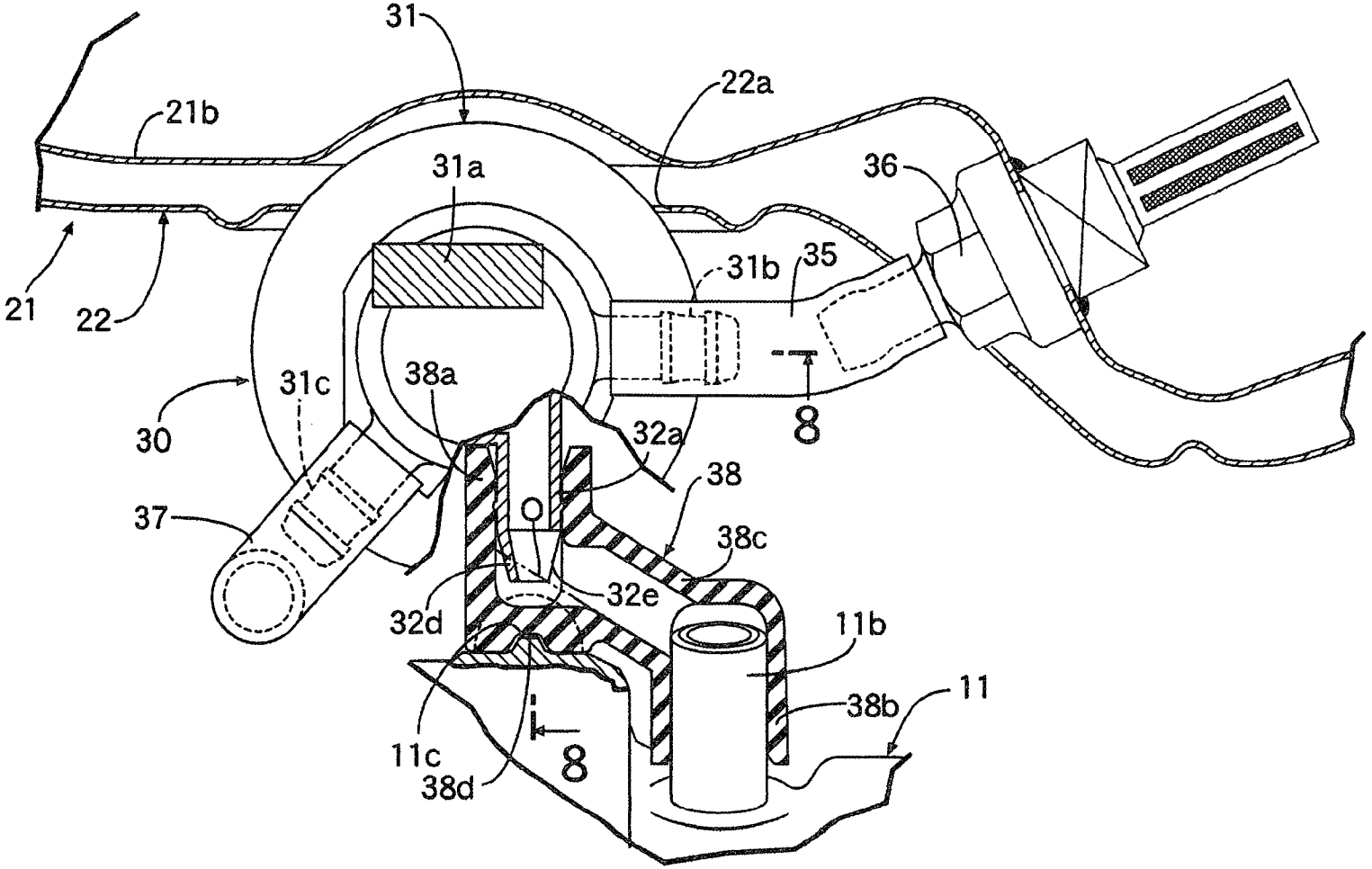
FIG. 7 is an enlarged cross sectional view taken along line 7-7 in FIG. 6.
Figure 8:
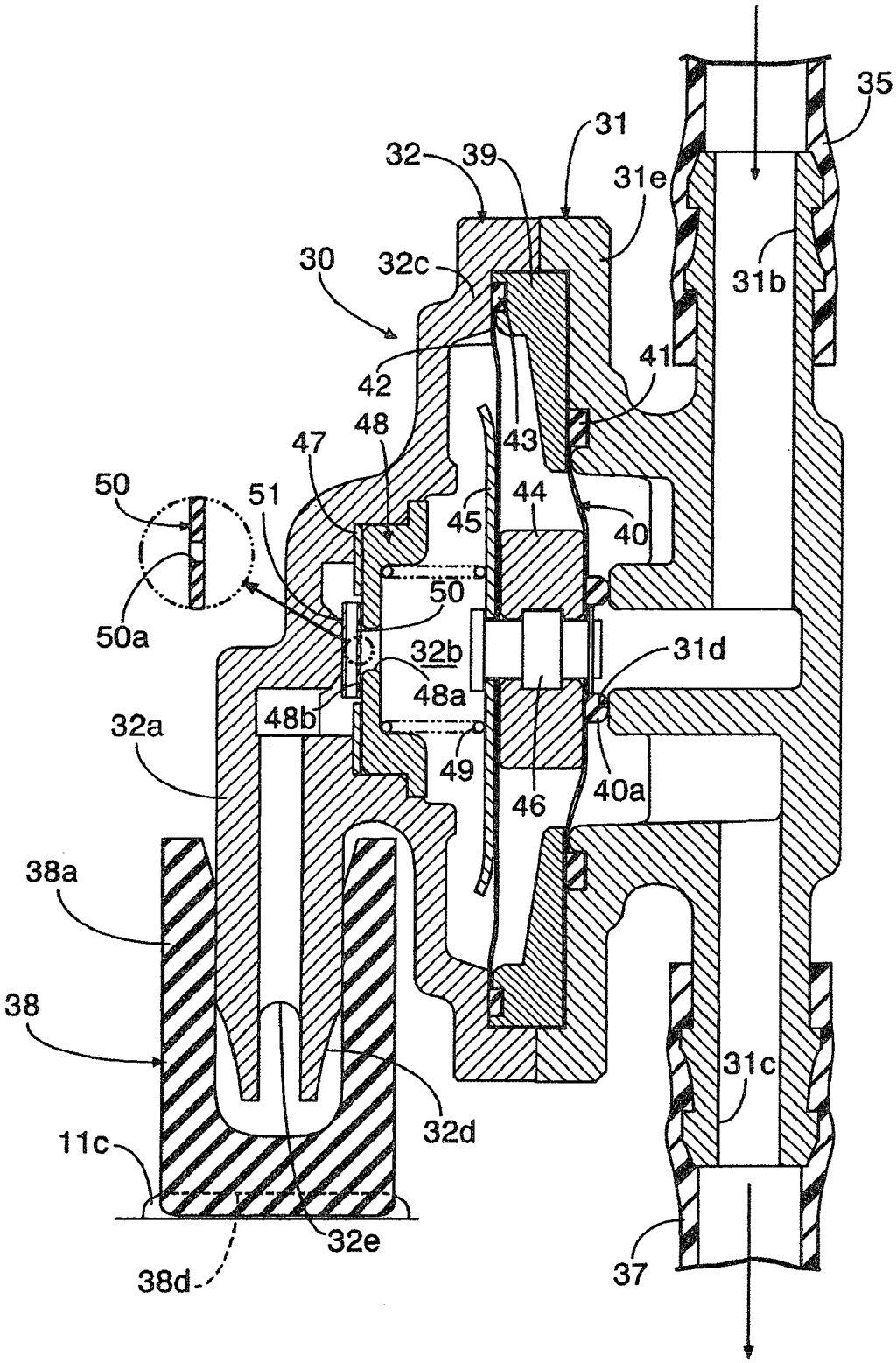
FIG. 8 is an enlarged cross sectional view taken along line 8-8 in FIG. 7.
Figure 9:
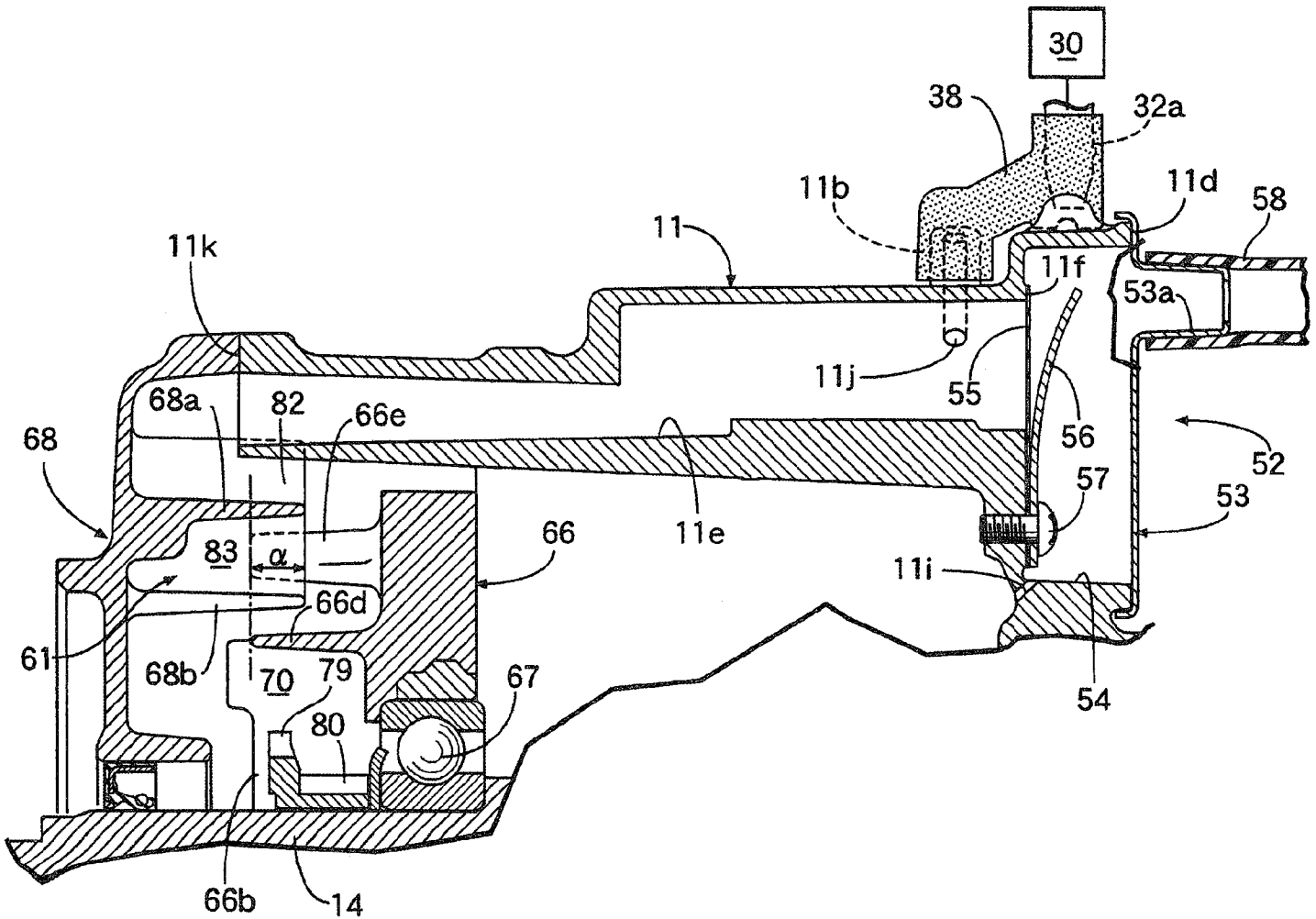
FIG. 9 is an enlarged cross sectional view taken along line 9-9 in FIG. 6 or FIG. 10.
Figure 10:
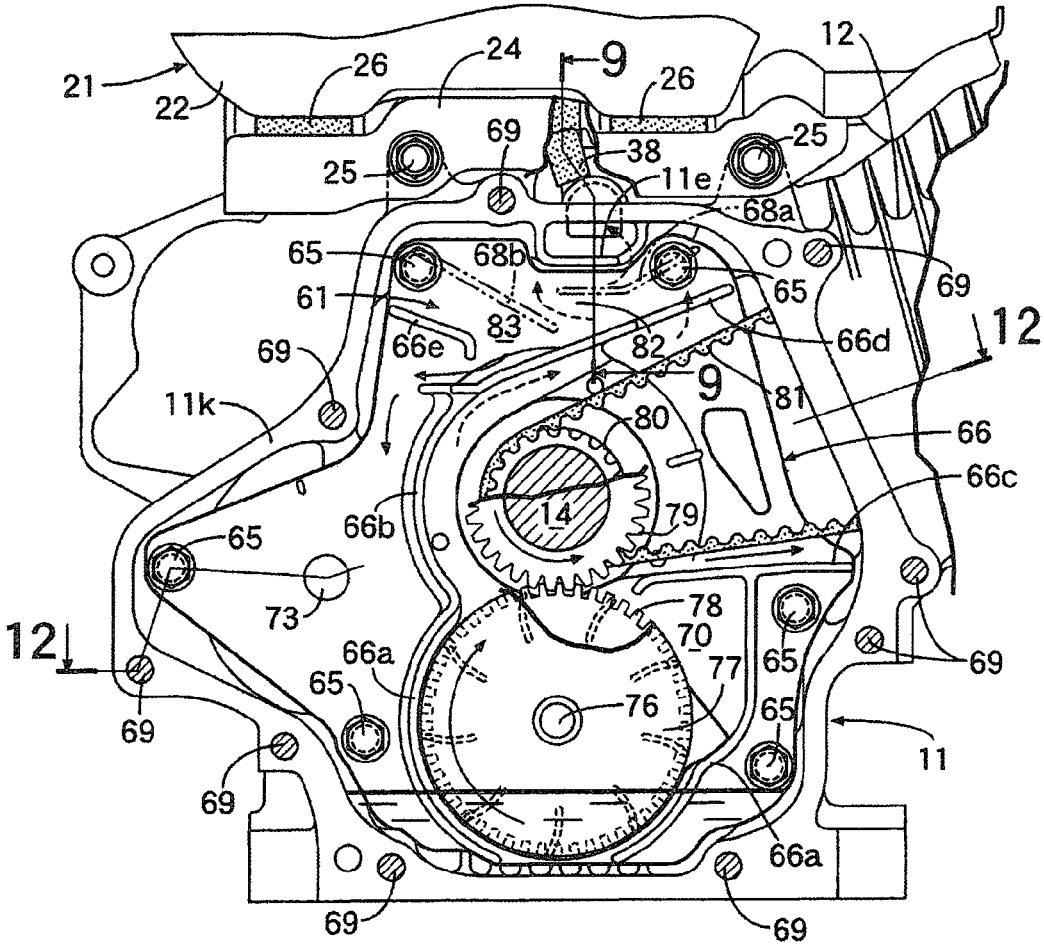
FIG. 10 is an enlarged cross sectional view taken along line 10-10 in FIG. 2.
Figure 11:
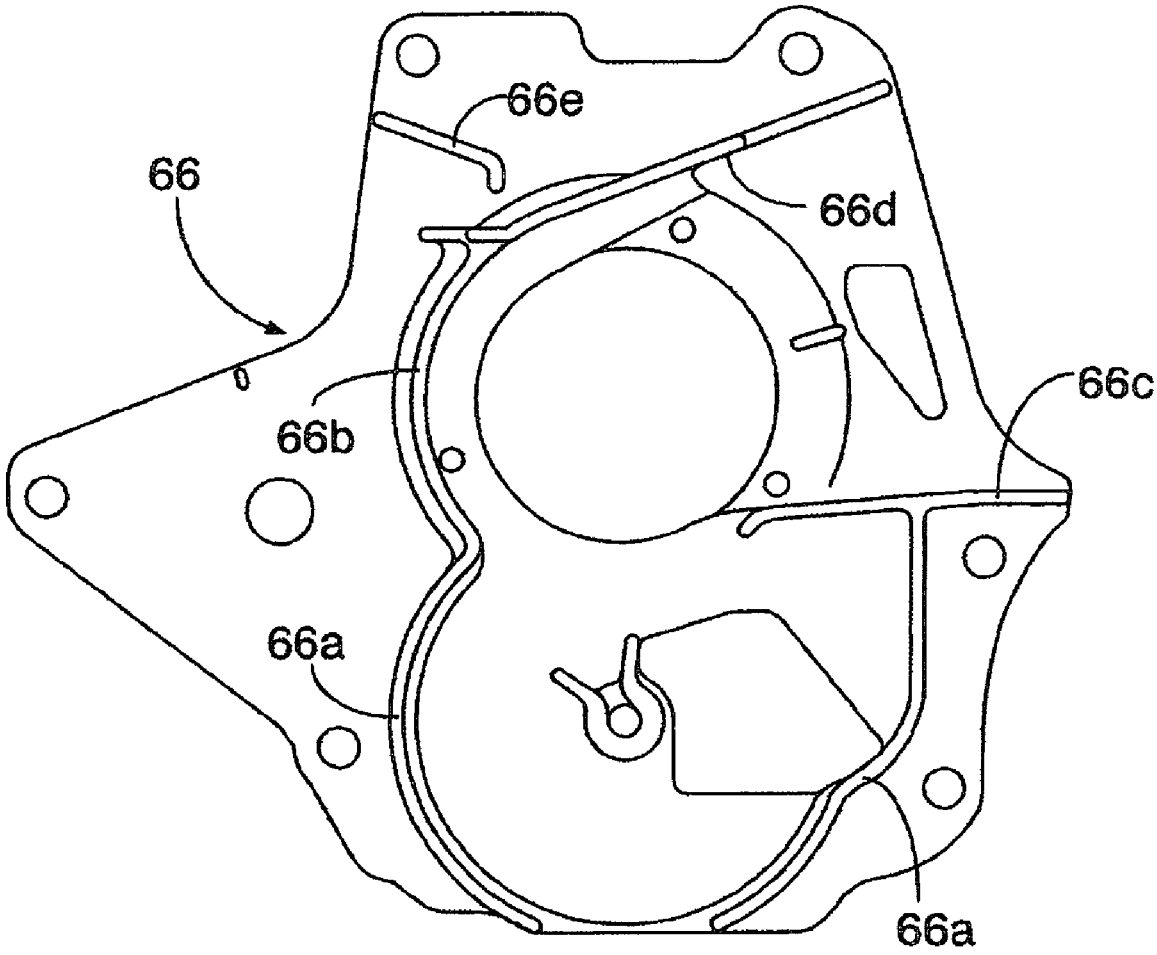
FIG. 11 is a partial view of FIG. 10.
Figure 12:
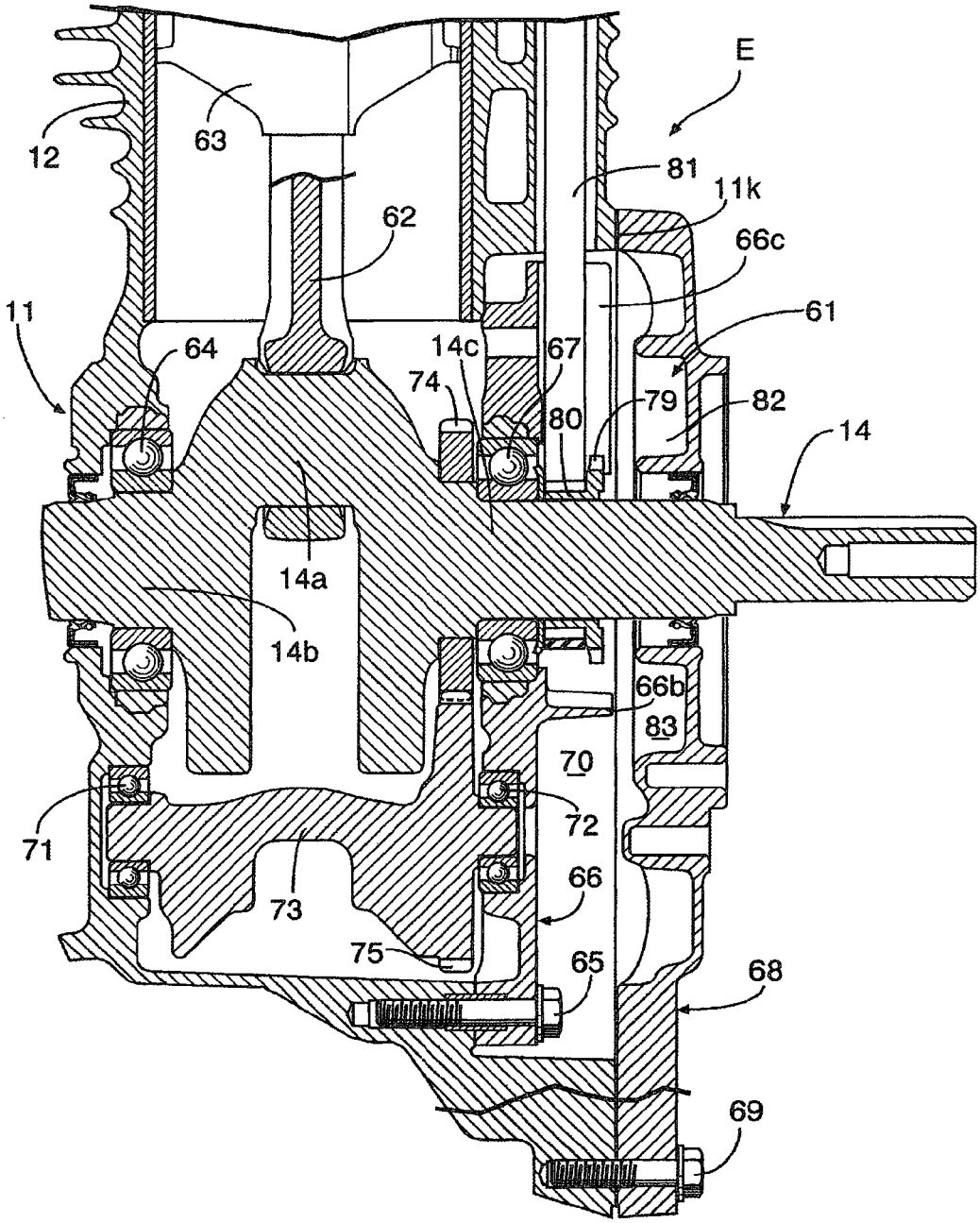
FIG. 12 is a cross sectional view taken along line 12-12 in FIG. 10.

FIGS. 1 to 12 show an exemplary embodiment of the present invention. FIG. 1 is a front view of a general purpose engine. FIG. 2 is a view when being viewed from the arrow 2 in FIG. 1. FIG. 3 is an enlarged cross sectional view taken along line 3-3 in FIG. 1. FIG. 4 is a view when being viewed from the arrow 4 in FIG. 3. FIG. 5 is an enlarged cross sectional view taken along line 5-5 in FIG. 4. FIG. 6 is an enlarged cross sectional view taken along line 6-6 in FIG. 2. FIG. 7 is an enlarged cross sectional view taken along line 7-7 in FIG. 6. FIG. 8 is an enlarged cross sectional view taken along line 8-8 in FIG. 7. FIG. 9 is an enlarged cross sectional view taken along line 9-9 in FIG. 6 and FIG. 10. FIG. 10 is an enlarged cross sectional view taken along line 10-10 in FIG. 2. FIG. 11 is a partial view of FIG. 10. FIG. 12 is a cross sectional view taken along line 12-12 in FIG. 10.

As shown in FIG. 1 and FIG. 2, in a single cylinder four cycle engine E, a cylinder head 12 and a head cover 13 are arranged so as to be raised in relation to an engine case 11 having a crank case and a cylinder block as one unit with a cylinder axis line L slightly tilted. The crank shaft 14 is projected from an end surface of the engine case 11, and a recoil starter 16 for cranking and starting the crank shaft 14 is provided on an outer surface of a cover 15 which covers another end surface of the engine case 11. A carburetor 17 is provided at the side of the cylinder head 12, and an intake passage 18 extending upward from the carburetor 17 is connected to an air cleaner 19. A muffler 20 is attached so as to align with the air cleaner 19 above the cylinder head 12 and the head cover 13, and a fuel tank 21 is attached nearer the crank case than the air cleaner 19 and the muffler 20.

The fuel tank 21 is constituted in such a way that a lower edge of a tank upper 21*a*, an upper edge of a tank lower 21*b* and an upper edge of a tank holder 22 are combined as one unit by a caulking part 23. A tank stay 24 is fixed to four attachment bosses 11*a* projected on the engine case 11 with bolts 25, and outer circumference parts of four rubber bushes 26 are supported by an upper surface of the tank stay 24. A bolt 27 penetrating from below to above of the center of each rubber bush 26 penetrates the tank holder 22 and a reinforcing plate 28 to be engaged with a nut 29, and thus the fuel tank 21 is supported above the engine case 11 without vibration.

As shown in FIG. 3 and FIGS. 6 to 8, an auto fuel cock 30 for automatically feeding fuel in the fuel tank 21 to the carburetor 17 during the operation of the engine E is attached to a lower surface of the fuel tank 21. The auto fuel cock 30 includes a first housing 31 and a second housing 32 combined as one unit, and a stay 31*a* (see FIG. 6) projected from the first housing 31 is fixed to a lower surface of the tank holder 22 with a bolt 33 and a nut 34. Here, an upper part of the auto fuel cock 30 is projected upward through an opening 22*a* (see FIG. 7) of the tank holder 22, and a lower part of the auto fuel cock 30 is projected downward through an opening 24*a* (see FIGS. 3 and 6) of the tank stay 24.

As most clearly shown in FIG. 8, the first housing 31 of the auto fuel cock 30 includes: a fuel entrance joint 31*b*; a fuel exit joint 31*c*; a valve seat 31*d* formed between the fuel entrance joint 31*b* and the fuel exit joint 31*c*; and a disc-shaped diaphragm supporting part 31*e*. Additionally, the second housing 32 includes: a first negative pressure introduction joint 32*a*; a negative pressure chamber 32*b* communicating with the first negative pressure introduction joint 32*a*; and a disc-shaped diaphragm supporting part 32*c*. The fuel entrance joint 31*b* is connected to a joint 36 provided on the lower surface of the fuel tank 21 via a first fuel hose 35, the fuel exit joint 31*c* is connected to the carburetor 17 via a second fuel hose 37, and the first negative pressure introduction joint 32*a* is connected to a second negative pressure introduction joint 11*b* of the engine case 11 via a negative pressure tube 38 made of rubber. Since the negative pressure tube 38 made of rubber is employed, the degree of freedom of lay-out of the fuel tank 21 to the engine case 11 can be raised.

A ring-shaped diaphragm supporting member 39 is held between the diaphragm supporting part 31*e* of the first housing 31 and the diaphragm supporting part 32*c* of the second housing 32. An outer circumference part of a first diaphragm 40 is fixed between the diaphragm supporting part 31*e* of the first housing 31 and the diaphragm supporting member 39 via a sealing member 41. The outer circumference part of a second diaphragm 42 is fixed between the diaphragm supporting part 32*c* of the second housing 32 and the diaphragm supporting member 39 via a sealing member 43. The first and second diaphragms 40 and 42, a spacer block 44 held between the center parts of the first and second diaphragms 40 and 42 and a disc-shaped spring sheet 45 brought into contact with a rear surface of the second diaphragm 42 are fixed as one unit with a rivet 46 penetrating them.

A valve seat forming member 48 is fitted between the first negative pressure introduction joint 32*a* of the second housing 32 and the negative pressure chamber 32*b* via a spacer plate 47. A valve body 40*a* formed on the center part of the first diaphragm 40 is energized in a direction to which the valve body 40*a* formed at the center of the first diaphragm 40 is seated on the valve seat 31*d* of the first housing 31 seat 31*d* of the first housing 31 with a valve spring 49 arranged between the valve seat forming member 48 and the spring sheet 45. An end of a reed valve 50 capable of sitting down on a valve seat 48*b* facing a through hole 48*a* penetrating the center part of the valve seat forming member 48 and an end of a stopper 51 for regulating the movable range of the reed valve 50 by covering the outer side thereof are fixed to the valve seat forming member 48 with a bolt (not shown). A fine through hole 50*a* for making the first negative pressure introduction joint 32*a* communicate with the negative pressure chamber 32*b* is formed in the reed valve 50.

As clearly shown in FIG. 7 and FIG. 8, a taper part 32*d* is formed at a lower end of the first negative pressure introduction joint 32*a* so that the negative pressure tube 38 can be easily inserted into the introduction joint 32*a*, and a reverse U-shaped notch 32*e* is formed on the taper part 32*d*. The negative pressure tube 38 includes: a first connection part 38*a* which vertically extends and is inserted into the first negative pressure introduction joint 32*a*; a second connection part 38*b* which vertically extends and is inserted into the second negative pressure introduction joint 11*b*; and a middle part 38*c* which obliquely extends downward from a lower end of the first connection part 38*a* to an upper end of the second connection part 38*b*, and is formed in an approximate crank shape. A linear recessed part 38*d* is formed on a bottom surface of the first connection part 38*a*. On the other hand, a linear projection 11*c* which fits into the linear recessed part 38*d* is formed on an upper surface of the engine case 11 facing the bottom surface of the first connection part 38*a* of the negative pressure tube 38, and the negative pressure tube 38 is positioned in a rotational direction around a vertical axis by engagement of the recessed part 38*d* and the projection 11*c*.

As clearly shown in FIG. 6 and FIG. 9, a breathing unit 52 provided on the side of the engine case 11 includes a breather chamber 54 surrounded by a ring-shaped circumference wall lid and a cover 53, and a breather passage 11*e* is opened at an end of the breather chamber 54. An end of a reed valve 55 capable of being seated down on a valve seat 11*f* formed at an opening part of the breather passage 11*e* and an end of a stopper 56 for regulating the movable range of the reed valve 55 are fixed to an inner wall of the breather chamber 54 with a bolt 57. A joint 53*a* is formed on the cover 53 so as to face another end of the breather chamber 54 far from the breather passage 11*e*, and is connected to an intake system of the engine E via a breather pipe 58. Two ribs 11*g*, 11*h* are projected in the breather chamber 54 in order to constitute a labyrinth 59 between the breather passage 11*e* and the joint 53*a*. A bottom part of the breather chamber 54 communicates with an inner space of the engine case 11 via an oil return hole 11*i*. Additionally, a communication hole 11*j* penetrating the inside of the second negative pressure introduction joint 11*b*, onto which the second connection part 38*b* of the negative pressure tube 38 is fitted, communicates with the breather passage 11*e*.

Next, the construction of a gas-liquid separating unit 61 of the engine E will be described with reference to FIGS. 9 to 12.

A pin part 14*a* of the crank shaft 14 of the engine E is connected to a piston 63 via a connecting rod 62. A journal part 14*b* of the crank shaft 14 is supported by the engine case 11 via a ball bearing 64. Another journal part 14*c* of the crank shaft 14 is supported by a bearing holder 66, which is fixed in the engine case 11 with six bolts 65, via a ball bearing 67. A covering member 68 is fixed to an opening 11*k* of the engine case 11 so as to cover a front surface of the bearing holder 66 with nine bolts 69, and an oil agitating chamber 70 is formed between the covering member 68 and the bearing holder 66.

Moreover, both ends of a first balancer shaft 73 (see FIG. 12) are supported between the engine case 11 and the bearing holder 66 via a pair of ball bearings 71 and 72. A driving gear 74 provided on the crank shaft 14 is engaged with a driven gear 75 provided on the first balancer shaft 73 so that the first balancer shaft 73 rotates at the same number of rotations as that of the crank shaft 14.

A rotor 77 is rotatably supported by a bottom part of the oil agitating chamber 70 via a rotor shaft 76. A driven gear 78 provided on the rotor shaft 76 is engaged with a driving gear 79 provided on the crank shaft 14 so that the rotor 77 is rotationally driven by the crank shaft 14. Additionally, a timing belt 81 wound around a driving sprocket 80 provided on the crank shaft 14 is connected to a driven sprocket (not shown) provided on the cylinder head 12.

As clearly shown in FIG. 10 and FIG. 11, a first rib 66*a* surrounding a part of the outer circumference of the rotor 77, a second rib 66*b* surrounding a part of the outer circumferences of the driving gear 79 and the driving sprocket 80, a third rib 66*c* lying to an end of the first rib 66*a* and is parallel with a lower surface of a lower bowstring of the timing belt 81, a fourth rib 66*d* lying to an end of the second rib 66*b* and is parallel with an upper surface of an upper bowstring of the timing belt 81, and an independent fifth rib 66*e* obliquely extending in a direction opposite to an oblique direction of the fourth rib 66*d* from the vicinity of a connection part of the second rib 66*b* and the fourth rib 66*d* are projected on the side of the bearing holder 66. Additionally, a first rib 68*a* and a second rib 68*b*, which are approximately parallel with the fourth rib 66*d* and the fifth rib 66*e* of the bearing holder 66 respectively, are projected on the side of the cover member 68.

The oil agitating chamber 70 is a region surrounded by the first to fourth ribs 66*a* to 66*d* of the bearing holder 66. A gas-liquid separating chamber 83 having a labyrinth 82 constituted by the fourth and fifth ribs 66*d* and 66*e* of the bearing holder 66 and the first and second ribs 68*a* and 68*b* of the cover member 68 is formed outside of the first to fourth ribs 66*a* to 66*d*. An upper part of the gas-liquid separating chamber 83 is made to communicate with the breathing unit 52 via the breather passage 11*e* (see FIG. 9).

Next, action the fuel feed system of the exemplary embodiment of the present invention including the above constitution will be described.

In FIG. 10, when the engine E is operated, the rotor 77 connected to the crank shaft 14 via the driving gear 79 and the driven gear 78 rotates in the oil agitating chamber 70, and the oil accumulated on the bottom part of the oil agitating chamber 70 is scrapped up and scattered. The scattered oil is guided between the third rib 66*c* and the fourth rib 66*d*, which are parallel with the timing belt 81 by the first and second ribs 66*a* and 66*b* of the bearing holder 66, adhere to the timing belt 81 and is fed to a valve chamber (not shown) of the cylinder head 12, thereby lubricating a valve mechanism. Air including oil mist generated in the oil agitating chamber 70 pass through the labyrinth 82 constituted by the fourth and fifth ribs 66*d* and 66*e* of the bearing holder 66 and the first and second ribs 68*a* and 68*b* of the cover member 68 in the gas-liquid separating chamber 83, and the oil separated during the passage falls along the first and second ribs 66*a* and 66*b* to be returned to the bottom part of the oil agitating chamber 70.

Since the bearing holder 66 which includes the ball bearing 67 for supporting the crank shaft 14 is fixed so as to face the opening ilk of the engine case 11, and the gas-liquid separating chamber 83 is formed between the cover member 68 combined with the opening ilk and the bearing holder 66, the bearing holder 66 can be used as a part of a wall surface of the gas-liquid separating chamber 83. Therefore, the number of parts can be increased compared with a case where a part of the wall surface of the gas-liquid separating chamber 83 is constituted by a specific member, and miniaturization, lightening, simplification of the shape of the engine case 11 can be realized compared with a case where a part of the side wall of the gas-liquid separating chamber 83 is constituted by a partition wall integrally formed with the engine case 11.

In addition, since the labyrinth 82 is provided in the gas-liquid separating chamber 83, the oil mist included in the air in the engine case 11 can be effectively separated. In particular, the labyrinth 82 is constituted in such a way that the fourth and fifth ribs 66*d* and 66*e* projecting from the bearing holder 66 side are mutually overlapped with the first and second ribs 68*a* and 68*b* projected from the cover member 68 by the distance $\alpha$ (see FIG. 9), and therefore the complicated labyrinth 82 is constituted with a simple structure and a gas-liquid separation effect can be further raised.

In FIG. 9, the air from which the oil caulking removed in the labyrinth 82 of the gas-liquid separating chamber 83 passes through the reed valve 55 of the breather passage 11*e* and the breathing unit 52, and is fed to the breather chamber 54. That is, the pressure pulsation generated in accordance with reciprocation of the piston 63 is transmitted to the breather passage 11*e*, and the reed valve 55 is opened when the pressure in the breather passage 11*e* becomes positive pressure, or is shut when the pressure therein becomes negative pressure, by which, the air in the breather passage 11*e* is fed to the breather chamber 54.

In FIG. 6, the oil, which is included in the air fed to the breather chamber 54, has not been completely separated from the air by the gas-liquid separating unit 61, is further separated while the air passes through the labyrinth 59 constituted by the ribs 11*g* and 11*h*, and is returned to a bottom part of the engine case 11 through the oil return hole 11*i* provided on the bottom part of the breather chamber 54. The air, from which the oil mist is separated by the gas-liquid separating unit 61, is introduced to the breathing unit 52 via the breather passage 11*e* and further subjected to the gas-liquid separation. Therefore, the consumption amount of oil can be further reduced. Although the air, from which the oil caulking thus separated, still includes fuel vapor which blows from a combustion room to the inside of the engine case 11, the air including the fuel vapor is returned to the intake system of the engine E through the joint 53*a* of the cover 53 and the breather pipe 58, and prevented from diffusing into the atmosphere by combustion of the fuel vapor and air-fuel mixture.

In FIG. 9, the pressure pulsation in the engine case 11 is transmitted to the first negative pressure introduction joint 32*a* of the auto fuel cock 30 through the breather passage 11*e*, the communication hole 11*j* and the negative pressure tube 38. In FIG. 8, when the pressure transmitted to the first negative pressure introduction joint 32*a* of the auto fuel cock 30 becomes negative pressure, the reed valve 50 goes away from the valve seat 48*b* and the pressure in the negative pressure chamber 32*b* becomes negative pressure. Inversely, when the pressure transmitted to the first negative pressure introduction joint 32*a* of the auto fuel cock 30 becomes positive pressure, the reed valve 50 sits down on the valve seat 48*b* and the negative pressure in the negative pressure chamber 32*b* is maintained. Since the negative pressure in the negative pressure chamber 32*b* is thus always maintained during the operation of the engine E, the first and second diaphragms 40 and 42 move left (in FIG. 8) against elastic force of the valve spring 49 and the valve body 40*a* formed on the first diaphragm 40 goes away from the valve seat 31*d*. As a result, the fuel in the fuel tank 21 is fed to the carburetor 17 via the first fuel hose 35, the fuel entrance joint 31*b*, a gap between the valve seat 31*d* and the valve body 40*a*, the fuel exit joint 31*c* and the second fuel hose 37.

Moreover, the first and second diaphragms 40 and 42 are energized in a right direction (in FIG. 8) by the elastic force of the valve spring 49 when the engine E stops and the pressure pulsation in the breather passage 11*e* disappears, and therefore the reed valve 50 suctioned in the right direction sits down on the valve seat 48*b* so that the negative pressure chamber 32*b* is sealed. However, since the air flows into the negative pressure chamber 32*b* from the first negative pressure introduction joint 32*a* via the fine through hole 50*a* provided in the valve seat 50, the valve body 40*a* sits down on the valve seat 31*d* by the elastic force of the valve spring 49 and the auto fuel cock is shut. Therefore, the fuel feed from the fuel tank 21 to the carburetor 17 can be automatically stopped with the stopping of the engine E.

The combinations of the negative pressure tube 38 and the first and second negative pressure introduction joints 32*a* and 11*b* are performed in accordance with the following steps. That is, the tank stay 24 is previously assembled to the tank holder 22 of the fuel tank 21 via the rubber bushes 26, and the first fuel hose 35 is previously assembled to the auto fuel cock 30. On the other hand, the second connection part 38*b* of the negative pressure tube 38 is previously fitted onto the second negative pressure introduction joint 11*b* of the engine case 11. Here, the recessed part 38*d* on the bottom surface of the first connection part 38*a* of the negative pressure tube 38 is engaged with the projection 11*c* of the engine case 11 (see FIG. 7) so that the negative pressure tube 38 can be positioned in the rotation direction. The fuel tank 21 is made to approach the engine case 11 from above in this state, the first negative pressure introduction joint 32*a* of the auto fuel cock 30 is fitted into the first connection part 38*a* of the negative pressure tube 38, and thereafter the tank stay 24 is fitted to the engine case 11 with the bolts 25. Then, the second fuel hose 37 communicating with the carburetor 17 is fitted onto the fuel exit joint 31*c* and the attachment is completed.

Thus, it is possible to fit the negative pressure tube 38 onto the first and second negative pressure introduction joints 32*a* and 11*b* only by making the fuel tank 21 approach the engine case 11 from above, and assembly work of the negative pressure tube 38 is simplified. Additionally, since the recessed part 38*d* of the negative pressure tube 38 is engaged with the projection 11*c* of the engine case 11 and the negative pressure tube 38 is positioned, work for fitting the first negative pressure introduction joint 32*a* of the auto fuel cock 30 into the first connection part 38*a* of the negative pressure tube 38 becomes easy. In addition, the vertical movement of the negative pressure tube 38 once equipped is regulated, and the tube cannot be removed unless the fuel tank 21 is removed. Therefore, it is unnecessary to prevent pulling-off of the negative pressure tube 38 with a clip, etc.

If the assembly work of the negative pressure tube 38 is performed after the fuel tank 21 is fixed to the engine case 11, not only a working space, where the negative pressure tube 38 is bent to fit onto the first and second negative pressure introduction joints 32*a* and 11*b*, is needed, but also the negative pressure tube 38 itself is enlarged. Therefore, the fuel tank 21 cannot be arranged in the vicinity of the engine case 11, and the whole engine E is enlarged.

If the oil mist in the engine case 11 is accumulated inside of the negative pressure tube 38 or inside of the first negative pressure introduction joint 32*a*, the pressure pulsation in the breather passage 11*e* cannot be transmitted to the negative pressure chamber 32*b* of the auto fuel cock 30 and there is a possibility that a malfunction of the auto fuel cock 30 occurs. However, according to the present exemplary embodiment, the air, from which almost the oil caulking removed by the gas-liquid separating unit 61, is fed to the breather passage 11*e*, and the pressure pulsation in the breather passage 11*e* is introduced into the auto fuel cock 30. Therefore, the malfunction of the auto fuel cock 30 caused by the oil mist can be previously prevented.

In particular, since the breather passage 11*e* for feeding the air passed through the gas-liquid separating unit 61 to the breathing unit 52 is provided at an upper part of the engine case 11, infiltration of the oil mist into the breather passage 11*e* can be further effectively prevented. In addition, since the auto fuel cock 30 is made to operate with use of the pressure pulsation in the breather passage 11*e*, it is unnecessary to form the specific passage for transmitting the pressure pulsation to the auto fuel cock 30.

Additionally, the negative pressure tube 38 includes the first connection part 38*a* which vertically extends and is inserted into the first negative pressure introduction joint 32*a*, the second connection part 38*b* which vertically extends and is inserted into the second negative pressure introduction joint 11*b*, and the middle part 38*c* which obliquely extends downward from the lower end of the first connection part 38*a* to the upper end of the second connection part 38*b*. Therefore, even if the oil mist infiltrates into the negative pressure tube 38, the oil caulking discharged to the breather passage 11*e* by gravity without accumulating in the negative pressure tube 38, and a situation where the pressure pulsation is not transmitted to the auto fuel cock 30 can be previously avoided.

Further, since the taper part 32*d* is formed at the lower end of the first negative pressure introduction joint 32*a* of the auto fuel cock 30, insertion work of the first negative pressure introduction joint 32*a* into the first connection part 38*a* of the negative pressure tube 38 becomes easy. In addition, since the notch 32*e* is formed on the taper part 32*d*, the action of the notch 32*e* can prevent the first negative pressure introduction joint 32*a* from being closed even if the oil is accumulated on the lower end of the first connection part 38*a* as shown being circled by the chain line in FIG. 7 when the engine E is tilted. In particular, since the notch 32*e* is opened toward the middle part 38*c* side of the negative pressure tube 38, the notch 32*e* can be further reliably prevented from sinking beneath the oil.

Even if the negative pressure introduction joint 32*a* is cut off at an upper end of the taper part 32*d* (upper end of the notch 32*e*), the same effect as a case where the notch 32*e* is provided can be obtained. However, since the taper part 32*d* is eliminated, such cut-off makes the insertion of the negative pressure tube 38 difficult.

Additionally, since the auto fuel cock 30 operates by the negative pressure of the engine case 11 which is stronger than intake negative pressure of the engine E, the sufficient negative pressure is generated only by cranking by the recoil starter 16 and the fuel can be fed to the carburetor 17. In particular, the auto fuel cock 30 can be reliably made to operate by employment of the first and second diaphragms 40 and 42 even if the negative pressure is small.

The exemplary embodiment of the present invention has been described above, various design modifications can be performed without departing from the substance of the present invention.

Although the exemplary embodiment regarding a general purpose engine E has been described, for example, the present invention can be applied to engines for arbitrary uses.

Additionally, although the recessed part 38*d* provided on the negative pressure tube 38 and the projection 11*c* provided on the engine case 11 have been exemplified as a positioning part in the exemplary embodiment, the positional relationship between the recessed part and the projection may be reversible, and any shapes of the recessed part and the projection are applicable.

It will be apparent to those skilled in the art that various modifications and variations can be made to the described preferred embodiments of the present invention without departing from the spirit or scope of the invention. Thus, it is intended that the present invention cover all modifications and variations of this invention consistent with the scope of the appended claims and their equivalents.

The present application claims priority based on Japanese Patent Application No. P2005-183601 filed on Jul. 23, 2005, Japanese Patent Application No. P2005-183602 filed on Jul. 23, 2005, and Japanese Patent Application No. P2005-183603, the contents of them are incorporated herein by reference.

INDUSTRIAL APPLICABILITY

The present invention is applicable to a fuel feed system of an engine in which an auto fuel cock for controlling fuel feed from a fuel tank to the engine is operated by pressure pulsation of air in an engine case.

Additionally, the present invention is applicable to a fuel feed system of an engine in which an auto fuel cock is arranged between an engine case and a fuel tank fixed above the engine case, and in which an inside of the engine case is connected to the auto fuel cock via a negative pressure tube.

What is claimed is:

1. A fuel feed system of an engine in which an auto fuel cock for controlling fuel feed from a fuel tank to the engine is operated by pressure pulsation of air in an engine case, the fuel feed system comprising:

a gas-liquid separating unit that separates oil mist generated in the engine case from air, wherein the auto fuel cock is operated by pressure pulsation of air from which the oil mist is separated by the gas-liquid separating unit, and wherein the auto fuel cock includes a first diaphragm and a second diaphragm.

2. The fuel feed system of an engine according to claim 1, further comprising:

a breather passage that feeds the air from which the oil mist is separated by the gas-liquid separating unit to a breathing unit, wherein the breather passage is connected to the auto fuel cock.

3. The fuel feed system of an engine according to claim 2, wherein the breather passage is arranged at an upper part of the engine case.

4. The fuel feed system of an engine according to claim 2, wherein a first negative pressure introduction joint provided on the auto fuel cock is connected to a second negative pressure introduction joint provided on the breather passage via a negative pressure tube.

5. The fuel feed system of an engine according to claim 4, wherein the negative pressure tube is monotonously tilted downward from the first negative pressure introduction joint to the second negative pressure introduction joint.

6. A fuel feed system of an engine comprising:

an engine case;

a fuel tank fixed above the engine case;

an auto fuel cock arranged between the engine case and the fuel tank and fixed to a lower surface of the fuel tank; and a negative pressure tube, wherein the inside of the engine case is connected to the auto fuel cock via the negative pressure tube, wherein the auto fuel cock includes a first negative pressure introduction joint projected downward, the engine case includes a second negative pressure introduction joint projecting upward from an upper surface of the engine case, the negative pressure tube includes a first connection part fitted onto the first negative pressure introduction joint and a second connection part fitted onto the second negative pressure introduction joint, and the negative pressure tube is positioned so that the first connection part of the negative pressure tube, of which the second connection part is fitted onto the second negative pressure introduction joint, is located on a movement passage of the first negative pressure introduction joint of the auto fuel cock, when the fuel tank to which the auto fuel cock is fitted is moved downward to be fixed above the engine case.

7. The fuel feed system of an engine according to claim 6, wherein a positioning part for regulating an attachment posture of the negative pressure tube to the engine case is provided between the negative pressure tube and the engine case.

8. The fuel feed system of an engine according to claim 7, wherein the positioning part includes a recessed part provided on the negative pressure tube and a projection provided on the engine case.

9. The fuel feed system of an engine according to claim 7, wherein the positioning part has a projection provided on the negative pressure tube and a recessed part provided on the engine case.

10. The fuel feed system of an engine according to claim 6, wherein a taper part of which the outer diameter is reduced downward is formed at a lower end of the first negative pressure introduction joint of the auto fuel cock.

11. The fuel feed system of an engine according to claim 6, wherein the negative pressure tube is monotonously tilted downward from the first negative pressure introduction joint to the second negative pressure introduction joint.

12. The fuel feed system of an engine according to claim 6, wherein the negative pressure tube includes a middle part between the first connection part and the second connection part, and is formed in an approximate crank shape, and the first negative pressure introduction joint includes a notch at the lower end thereof.

13. The fuel feed system of an engine according to claim 12, wherein the notch of the first negative pressure introduction joint is opened toward the middle part side of the negative pressure tube.

14. The fuel feed system of an engine according to claim 6, further comprising:

a gas-liquid separating unit for separating oil mist generated in the engine case from air, wherein the auto fuel cock is operated by pressure pulsation of air from which oil mist is separated by the gas-liquid separating unit.

15. The fuel feed system of an engine according to claim 14, further comprising:

a breather passage that feeds the air from which the oil mist is separated by the gas-liquid separating unit to a breathing unit, wherein the breather passage is connected to the auto fuel cock.

16. The fuel feed system of an engine according to claim 15, wherein the breather passage is arranged at an upper part of the engine case.

* * * * *